US006737106B1

(12) United States Patent
Kempe et al.

(10) Patent No.: US 6,737,106 B1
(45) Date of Patent: May 18, 2004

(54) METHODS FOR SPRAY-ON INSULATION

(75) Inventors: Steven A. Kempe, Richmond, TX (US); William F. Boyer, Pearland, TX (US); Harry Joe Witt, Richmond, TX (US)

(73) Assignee: International Cellulose Corporation, Houston, TX (US)

( * ) Notice: Subject to any disclaimer, the term of this patent is extended or adjusted under 35 U.S.C. 154(b) by 0 days.

(21) Appl. No.: 10/455,758

(22) Filed: Jun. 5, 2003

(51) Int. Cl.[7] ..... B05D 1/12

(52) U.S. Cl. ..... 427/180; 427/181; 427/236; 427/324; 427/421

(58) Field of Search ..... 427/180, 181, 427/236, 324, 421

(56) References Cited

U.S. PATENT DOCUMENTS

| | | | | |
|---|---|---|---|---|
| 4,187,983 | A | 2/1980 | Boyer | 239/9 |
| 4,360,440 | A | 11/1982 | Boyer et al. | 252/62 |
| 4,923,121 | A | 5/1990 | Boyer | 239/434.5 |
| 5,082,563 | A | 1/1992 | Webb et al. | 210/631 |
| 5,352,780 | A | 10/1994 | Webb et al. | 526/56 |
| 5,429,741 | A | 7/1995 | Webb et al. | 210/242.4 |
| 5,684,068 | A | 11/1997 | Boyer et al. | 524/40 |
| 5,853,802 | A | 12/1998 | Boyer et al. | 427/207.1 |
| 6,251,476 | B1 | 6/2001 | Boyer et al. | 427/207.1 |

OTHER PUBLICATIONS

ACUSOL detergent polymers, Rohm & Haas, 1991, 1 page.

*Primary Examiner*—Bernard Pianalto
(74) *Attorney, Agent, or Firm*—Guy McClung

(57) ABSTRACT

A method for applying fibrous cellulose insulation to a substrate such as a wall, ceiling, attic part or floor which includes, in at least certain embodiments, mixing cellulose fibers with an adhesive and a discoloration reducing additive and applying the resulting mixture to the substrate.

17 Claims, No Drawings

METHODS FOR SPRAY-ON INSULATION

BACKGROUND OF THE INVENTION

1. Field of the Invention

This invention is directed to methods for applying insulation material and to such methods that include reduction of undesirable discoloration of insulating material.

2. Description of Related Art

A wide variety of spray-on cellulose insulation materials and systems for spraying insulation on ceilings, floors, and walls are disclosed in the prior art. The prior art discloses various "stabilized" spray-on or blow-in insulations for cavity walls which include loose fill fibers, moisture, adhesive material or both, to produce a somewhat rigid, stabilized mass with a desired reduced density. Such a mass in certain applications has some wet strength and is self-supporting temporarily. In one aspect such a prior art method employs some dry adhesive material that is activated by water. Certain of these prior art methods result in wasting an amount of sprayed-on or blown-in material which exits the area to which they are to be applied. Such material that is not deposited at the desired location, typically in the form of dust and overspray, must be collected and recycled or disposed of. Moving air can affect a surface to which such a mixture is applied, removing fibers from the surface and relocating them in an undesirable location. Such a mixture may settle and pack down in an undesired manner and may be easily damaged by workers and tradespeople working in the location.

Two-component adhesive resins are commonly used with sprayed-on and blown-in fibrous cellulose insulating materials. U.S. Pat. No. 4,187,983, co-owned with the present invention and incorporated here fully for all purposes, discloses prior art systems for applying fibrous cellulose insulation material with an adhesive. U.S. Pat. No. 4,360,440, co-owned with the present invention and incorporated fully herein for all purposes, discloses insulating fiber mixtures that include water, fibers, and an adhesive that is a combination of sodium silicate and an acrylic resin. U.S. Pat. Nos. 5,684,068 and 5,853,802, both co-owned with the present invention and fully incorporated herein for all purposes, disclose spray-on insulation compositions with cellulose fibers and a polyvinyl alcohol adhesive and, in certain aspects, an acrylic resin.

Certain spray-on insulation materials that include an alcohol-contianing adhesive [e.g., a polyvinyl alcohol] as applied exhibit a whitish discoloration that, in some applications, is undesirable. There has been a need, recognized by the present inventor, for a spray-on insulation material that, when applied, reduces, inhibits, or eliminates undesirable discoloration or whitening.

SUMMARY OF THE PRESENT INVENTION

The present invention, in certain aspects, discloses a method for reducing or inhibiting undesirable discoloration of cellulose fiber insulation, the method including mixing cellulose fibers with an adhesive in aqueous solution and with a discoloration reducing additive thereby producing a mixture, and applying the mixture to a surface of the substrate. The present invention, in certain embodiments, discloses a spray-on fibrous cellulose insulation mixture that includes the insulating cellulose fibers; one or two components of a two-component resin adhesive material (with or without added water in the adhesive); and a dispersant [e.g., a dispersant, detergent polymer, water-soluble polymer for reducing encrustation, polyacrylate polymer, and/or acrylic and polyacrylic acid mateials], e.g., but not limited to commercially available Rohm & Haas ACUSOL™ 445 dispersant polymer material.

In certain particular embodiments the fibers are mixed with an "alcohol" adhesive e.g., but not limited to, polyvinyl alcohol adhesives, (e.g. but not limited to those disclosed in U.S. Pat. Nos. 5,684,068 and 5,853,802, and in prior art cited therein all incorporated fully herein by reference) or with alcohol-containing adhesives. In certain systems that use spray-on nozzles, this mixing occurs at the nozzle.

In one system according to the present invention, fibrous cellulose is provided in one line to a plural-component spray nozzle and an adhesive component (e.g., but not limited to, an A component, and A and a B component, or alcohol-containing adhesive as described herein) with dipsersant material is provided in another line to the nozzle.

The use of certain mixtures according to the present invention results in reducing or eliminating undesirable discoloration or whitening [which, in certain prior art applications, may appear on the surface of sprayed-on insulation as applied].

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures.

It is, therefore, an object of at least certain preferred embodiments of the present invention to provide: new, useful, unique, efficient, nonobvious safe spray-on insulation materials;

Such materials and methods of their use which reduce or eliminate undesirable discoloration or whitening; and Such materials and methods of their use which use a PVOH (polyvinyl alcohol) and a dispersant.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF EMBODIMENTS PREFERRED AT THE TIME OF FILING FOR THIS PATENT

In certain embodiments of the present invention a mixture is produced for spraying onto a floor (either or both surfaces—top and/or bottom) or onto a wall or part of a wall to produce an insulated section thereof. The applied material may or may not, according to the present invention, be enclosed between panels or boards and/or sprayed into a pre-built wall or under-floor cavity; e.g. an outer wall surface and an inner surface of house exterior sheathing may define a wall cavity or a bottom surface of a floor and top surface of a ceiling or of some other board or sheathing may define a cavity beneath the floor into which the material is applied. In certain aspects the mixture has these properties:

| Using an A component only | |
|---|---|
| "X Ratio": Water to Adhesive (by volume as applied) | 3:1 to 15:1 (10:1 preferred) |
| "Y Value": Adhesive Mix/Fibers (gallons of adhesive solution - or mixture - per pound of fibers) | .05 to .30 |
| "Z Ratio": Discoloration affecting addition (gallons) of adhesive per gallons of additive) | 5:1 to 50:1 |

In one preferred mixture using an A component only as the adhesive the ratio of water to adhesive is 10 to 1 and about 0.10 gallons of mixed adhesive are used per pound of cellulose fibers, and discoloration reducing additive [dispersant] is used in the form of Rohm & Haas ACUSOL™ 445 material and in the amount of one gallon of this dispersant per ten gallons of adhesive. In certain aspects when applying such a mixture to a floor, e.g. to the underside of a floor, the ratio of adhesive to water is increased and the ratio of adhesive mix to pounds of fiber is increased. Such "A component only" mixtures may be applied to a wall e.g. blown onto a wall with the adhesive and a water mist or sprayed onto a wall, into a wall cavity, or into an attic area, including the top side of the attic floor, the inside of the attic walls, and/or the underside of a roof. In certain wall or ceiling applications, with an "A component only" mixture, the X ratio is between 2:1 and 15:1 (with 4:1 preferred); and the Y value is between 0.10 and 0.40 (with 0.23 preferred). For certain cavity wall applications, the preferred Y Value is 0.10.

| Using an A and B component | |
|---|---|
| X Ratio: Water to Adhesive | 3:1 to 15:1 |
| Y value: Adhesive Mix/Fibers | .05 to .30 |
| Resin Ratio: A component/B component | 9:1 to 1:9 |
| Z Ratio: | 5:1 to 50:1 |

In one preferred mixture the Resin Ratio is 5:1; the X ratio is 10:1; and about 0.13 gallons of mixed adhesive and water is used per pound of fibers. In one preferred mixture the Resin Ratio is 3:1; the X ratio is 4:1; and about 0.23 gallons of mixed adhesive and water is used per pound of fibers. The Z ratio for these embodiments is 10:1. In certain cavity wall applications, the preferred Y Value is 0.13.

In certain embodiments of the present invention a mixture according to the present invention is applied in an attic as follows:

| | |
|---|---|
| Resin Ratio: | 9:1 to 1:9 (5:1 preferred) |
| X Ratio: | 4:1 to 50:1 (10:1 preferred) |
| Y Value: | .005 to 0.100 (preferred 0.010) |
| Z Ratio: | 5:1 and 50:1. (10:1 preferred) |

In an attic application as above in which an A component material only is used, there is no A to B ratio and the X ratio is between 3:1 and 50:1 with the Y value as above and a Z ratio of 5:1 to 50:1 with 10:1 preferred.

In one particular aspect, a mixture according to the present invention is as follows:

1 to 20 parts adhesive by volume 5 to 20 parts water by volume 0.1 to 2 parts dispersant by volume In one preferred mixture there is 1 part adhesive to 4 to 15 parts water; and, more preferably, 8 to 15 parts water. Such a mixture (between about 0.05 to 0.30 gallons) is then combined with one pound of fibers and with 0.10 gallons of dispersant per gallon of adhesive. In one aspect the adhesive is a polyvinyl-alcohol containing adhesive.

In certain particular embodiments fibers are combined with an alcohol-containing adhesive. In particular aspects, the alcohol-containing adhesive contains a polyvinyl alcohol (PVOH) and in one particular aspect the adhesive is a PVOH cooked without the addition an acidic medium or pH adjusting medium. "Cooked" means heated to a temperature at which a reaction occurs so that the powdered PVOH becomes liquid or gelatinous so that is mixes with water to form a solution. "Cooking is done by raising the temperature of water and PVOH, e.g. to between about 190 to 225 degrees Fahrenheit while agitating the water and PVOH and maintaining the raised temperature for sufficient time to produce the desired solution, one aspect for a minimum of one hour. In certain embodiments of insulating material produced according to the present invention a surfactant is used and/or a cross-linking agent. Any suitable known surfactants and cross-linking agents may be used. The fibers in any mixture described above may be treated with an acidic medium, such as borates and boric acid. This "treating" is done in one aspect by pounding or grinding the acidic material into the fibrous material, e.g. with a suitable hammer mill or other apparatus.

In certain embodiments a mixture according to the present invention as follows is applied to a substrate:

| Material | Ratio |
|---|---|
| Water to Adhesive (gallons water to gallons adhesive) | 3:1 to 15:1 |
| Adhesive to Cellulose Fibers [gallons adhesive to pounds of fiber; "adhesive" includes additive] | 0.05 to 0.30 |
| Adhesive to Additive (gallons adhesive to gallons additive) | 5:1 to 50:1 |

Desired resultant densities (density of the material after application and drying) for material according to certain embodiments of the present invention in a cavity wall are: about 1.5 to about 6.5 pounds per cubic foot and for certain embodiments between 1.5 to 2.5 pounds per cubic foot. In certain aspects, desired resultant densities for attic floors are between about 1 to about 4 pounds per cubic foot, and, in certain aspects, between about 1 to about 2 pounds per cubic foot (and in one aspect 2.0 or less).

In one particular mixture according to the present invention, to one part (by volume) of an A component such as a PVOH adhesive is added 3 to 15 parts (by volume) of water. To the resulting mixture is added between 0.05 gallons to 0.30 gallons (of adhesive+water) per pound of fibers, and a Z ratio of 10:1. In another particular method and system according to the present invention about 0.03 to about 0.75 gallons of a resin component A or of resin components A plus B are used per pound of fibers. In one embodiment 1 gallon of adhesive+dispersant is used to spray-on 220 pounds of fibers at 0.05 gallons/pound when reduced at a ratio of 10:1 with water.

With any method described above, for an applied mixture (adhesive+fibers), e.g. on an attic's floor top side, that can settle and pack down, it is preferred according to the present invention that such settling be no more than 5% and, with the methods and materials described for the preferred embodiments above, that it be no more than 2.5%.

The present invention, therefore, in at least certain but not necessarily all preferred embodiments provides a method for applying fibrous cellulose insulation to a wall, the method including mixing cellulose fibers with an adhesive in aqueous solution thereby producing a mixture, and applying the mixture to a surface of a wall. Such a method may include one or some (in any possible combination) of the following: wherein the adhesive is an alcohol-containing adhesive; wherein the alcohol-containing adhesive is a PVOH adhesive; wherein the PVOH adhesive is cooked with or without the addition of an acidic medium; wherein the adhesive is present as between about 0.05 to about 0.30 gallons of adhesive-in-water solution to about a pound of fibers; wherein the adhesive is present as between about 0.03 to about 0.75 gallons of adhesive-in-water solution to about a pound of fibers; wherein the ratio by volume of water to adhesive in the aqueous solution containing adhesive is between 3:1 to 15:1; wherein the adhesive is an A component only adhesive; wherein the ratio of water to adhesive in the aqueous solution is 10 to 1 and 0.10 gallons of the solution is used per pound of cellulose fibers; wherein the adhesive is a B component only adhesive; wherein the adhesive is an A+B component adhesive; wherein the ratio of A component to B component is between 9:1 to 1:9; the ratio of aqueous solution with adhesive (gallons) to fibers (pounds) is 0.05 to 0.30; wherein the ratio of A component to B component is 5:1; the ratio of water to adhesive in the aqueous solution is 10:1; and about 0.13 gallons of mixed adhesive and water is used per pound of cellulose fibers; prior to the mixing step, treating the cellulose fibers with an acidic material; wherein the treating is-done by pounding acidic material into the cellulose fibers; wherein the acidic material is boric acid; wherein the resultant density of the applied mixture is between 1.5 to 6.5 pounds per cubic foot; wherein the resultant density of the applied mixture is between 1.5 to 2.5 pounds per cubic foot; wherein the resultant density of the applied mixture is between 2.0 or less; wherein the mixture is applied by spraying it onto the wall; spraying the mixture with a spray nozzle onto the wall, the method including introducing the cellulose fibers under pressure through a first hose into the spray nozzle, introducing the adhesive in aqueous solution under pressure through a second hose into the spray nozzle, and spraying from the spray nozzle the mixture onto the wall; applying the mixture onto the wall to a thickness of at least 4 inches; applying the mixture onto the wall to a thickness of at least 6 inches; wherein the mixture occupies a first space as applied and, upon setting, occupies at least 95% or 99% of said first space; wherein the mixture occupies a first space as applied and, upon drying, occupies at least 99.5% of said first space; wherein a barrier is spaced-apart from and adjacent the wall forming a cavity between a surface of the barrier and a surface of the wall, the mixture deposited within the cavity; wherein the mixture occupies a first space as applied and, upon settling and drying, occupies at least 95%, 99% or 99.5% of said first space and/or wherein discoloration reducing additive is added to a polyvinyl alcohol adhesive [e.g. commercially available SK-2000™ material from International Cellulose Corporation] prior to combining this combination with cellulose insulation material. In certain embodiments the amount of adhesive (A Component only, or A Component plus B Component) used per one pound of cellulose fiber is: for cavity wall applications, between 0.003 gallons and 0.075 gallons; for attic applications, between 0.0001 gallons and 0.025 gallons; and for general wall and ceiling applications, between 0.006 gallons and 0.132 gallons.

In conclusion, therefore, it is seen that the present invention and the embodiments disclosed herein and those covered by the appended claims arc well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventor may rely on the Doctrine of Equivalents to determine and assess the scope of their invention and of the claims that follow as they may pertain to apparatus not materially departing from, but outside of, the literal scope of the invention as set forth in the followings claims. Any patent or patent application referred to herein is incorporated fully herein for all purposes.

What is claimed is:

1. A method for applying fibrous cellulose insulation to a substrate, the method comprising mixing cellulose fibers with an adhesive in aqueous solution and with a discoloration reducing additive thereby producing a mixture, and applying the mixture to a surface of the substrate.

2. The method of claim 1 wherein the adhesive is an alcohol-containing adhesive.

3. The method of claim 1 wherein the alcohol-containing adhesive is a polyvinyl alcohol adhesive.

4. The method of claim 3 wherein the polyvinyl alcohol adhesive is cooked with or without the addition of an acidic medium.

5. The method of claim 1 wherein the adhesive is present as between about 0.05 to about 0.30 gallons of adhesive-in-water solution to about a pound of fibers.

6. The method of claim 1 wherein the adhesive and the discoloration reducing additive are mixed together to form a pre-mixture prior to combining the pre-mixture with the cellulose fibers.

7. The method of claim 1 wherein the ratio by volume of water to adhesive in the aqueous solution containing adhesive is between 3:1 to 15:1.

8. The method of claim 1 wherein the ratio of water to adhesive in the aqueous solution is 10 to 1; 0.10 gallons of the solution is used per pound of cellulose fibers; and 1 gallon of discoloration reducing additive is used per 110 gallons of aqueous solution of water and adhesive.

9. The method of claim 1 wherein the ratio of aqueous solution to adhesive (gallons) to fibers (pounds) is 0.05 to 0.30.

10. The method of claim 1 wherein the ratio of water to adhesive in the aqueous solution is 10:1; and about 0.13 gallons of mixed adhesive and water is used per pound of cellulose fibers.

11. The method of claim 1 further comprising, prior to the mixing step, treating the cellulose fibers with an acidic material.

12. The method of claim 11 wherein the treating is done by pounding acidic material into the cellulose fibers.

13. The method of claim 12 wherein the acidic material is boric acid.

14. The method of claim 1 wherein the resultant density of the applied mixture is less than 2 pounds per cubic foot.

15. The method of claim 1 wherein the mixture is applied by spraying it onto the substrate.

16. A method for applying fibrous cellulose insulation to a substrate, the method comprising mixing cellulose fibers with an adhesive in aqueous solution and with a discoloration reducing additive thereby producing a mixture, applying the mixture to a surface of the substrate, and wherein the mixture occupies a first space as applied and, upon settling, occupies at least 95% of said first space.

17. The method of claim 16 wherein the resultant density of the mixture is between 1 and 4 pounds per cubic foot.

* * * * *